United States Patent [19]

DeGraff

[11] Patent Number: 4,900,014

[45] Date of Patent: Feb. 13, 1990

[54] CONVERTIBLE EXERCISE CYCLE

[76] Inventor: Alfred H. DeGraff, 6 Birch St., Saratoga Springs, N.Y. 12866-3834

[21] Appl. No.: 249,425

[22] Filed: Sep. 27, 1988

[51] Int. Cl.[4] ..... A63B 21/00; A61H 1/02

[52] U.S. Cl. ..... 272/73; 272/900; 128/25 R

[58] Field of Search ..... 272/73, 72, 93, 144, 272/DIG. 4, 67, 68, 132, 900; 128/25 R; 297/353, 383

[56] References Cited

U.S. PATENT DOCUMENTS

| | | | |
|---|---|---|---|
| 3,930,495 | 1/1976 | Marino | 272/73 |
| 4,402,502 | 9/1983 | Peters | 272/73 |
| 4,569,401 | 2/1986 | Luck | 272/73 |
| 4,662,361 | 5/1987 | Patterson | 128/25 R |

FOREIGN PATENT DOCUMENTS

| | | | |
|---|---|---|---|
| 1070769 | 8/1954 | France | 128/25 R |

*Primary Examiner*—Stephen R. Crow

*Attorney, Agent, or Firm*—Schmeiser, Morelle & Watts

[57] ABSTRACT

A portable exercise cycle which is convertible between an arm exerciser and a leg exerciser. A flywheel assembly is journaled in an upright frame which is mounted on an T-shaped base. Flywheel tension is adjustable. Two L-shaped lever members are mounted on opposite sides of the frame for manually rotating the flywheel. When used as a leg exerciser, the machine is placed on the floor and pedals are attached to the lever members. When used as an arm exerciser the machine is clamped to a table top, and handgrips are attached to the lever members. Limited grip handgrips are provided for those with limited gripping ability. An electronic display unit displays elapsed time, speed, and equivalent distance traveled.

5 Claims, 3 Drawing Sheets

FIG. 2
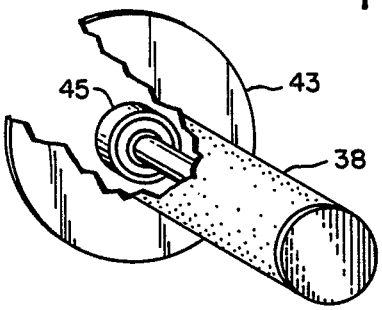
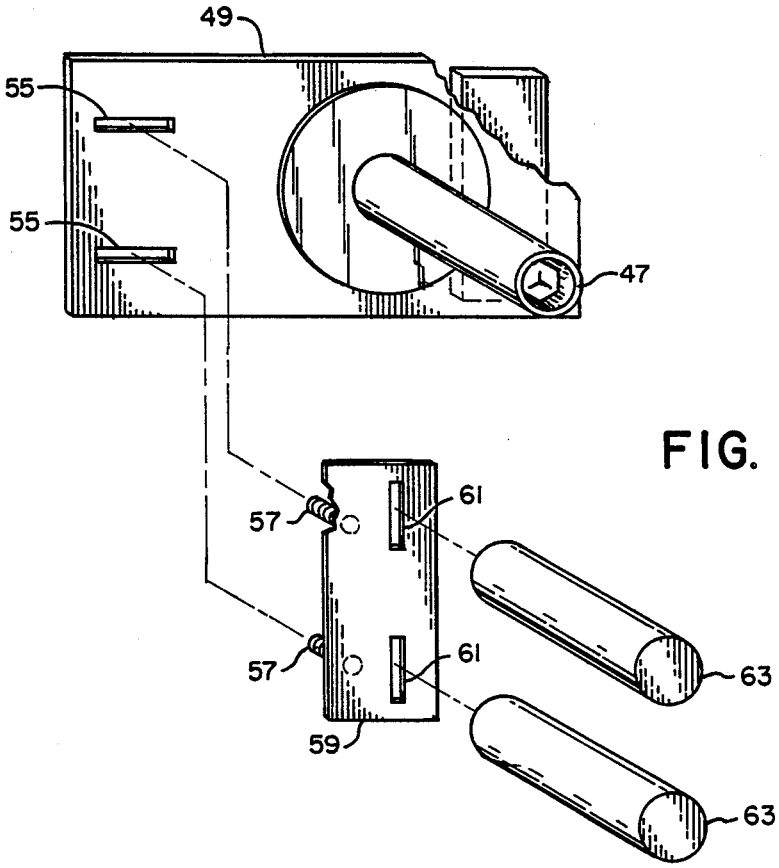
FIG. 3

CONVERTIBLE EXERCISE CYCLE

FIELD OF THE INVENTION

The present invention relates generally to exercising machines. More particularly, the present invention is an aerobic exercise cycle which is convertible between an arm exerciser and a leg exerciser.

BACKGROUND OF THE INVENTION

Aerobic exercise machines in the form of stationary bicycles are common and are well-known for providing a means for exercising leg muscles. Like their movable counterparts which are used for outdoor transportation, recreation, and exercise, stationary exercise bicycles are fairly large machines. Thus, once the stationary bicycle is placed in an indoor gym or basement, or any other room used for exercising, it is not moved with ease.

The above-described conventional exercise bicycles are excellent conditioning machines for most people. However, for those people who are unable to mount and to sit upon the seat of an exercise bicycle because of back problems or other disabilities, there is no suitable device presently available which provides similar conditioning.

Still further, while some exercise bicycles available provide means for exercising the arms during a cycling session, the user must simultaneously exercise the legs in a cycling motion to achieve the benefits of arm exercise from the machine. That is, exercise bicycles provide excellent means to achieve their primary objectives of aerobic exercise in addition to leg muscle toning, but have limited versatility otherwise.

The present inventor has developed a new type of aerobic exercise cycle which is convertible between an arm exerciser and a leg exerciser, without requiring simultaneous exercise of both. In particular, the new exercising machine is convertible between floor use as a stationary bicycle and table top use as an arm exerciser. In this regard, the new exercise cycle has a smaller frame than conventional cycles, thus being easily portable. Advantageously, the new exercise cycle is available for those people with disabilities which prevent them from using a conventional exercise bicycle, but who wish to obtain similar conditioning. Additionally, the new exercise cycle is useful as an arm exerciser for paraplegics and incomplete quadriplegics.

To fully appreciate the value of the subject invention and the shortcomings of the prior art, one must first understand the needs of the paraplegic or incomplete guadriplegic. For most, the onset of the disability marks the starting point for a variety of related problems which yield an overall deterioration in health.

One of the most significant difficulties involve the loss of the ability to participate in aerobic exercise. Obviously, the vast majority of aerobic exercises require the use of the lower limbs and are therefore not possible for paraplegics. However, even those aerobic exercise devices which do not require the use of lower limbs fail to accommodate the needs of the paraplegic and are therefor inappropriate for their use. These needs are based upon three primary physical difficulties faced by most paraplegics and incomplete quadriplegics. They are: loss of significant hand gripping strength; loss of upper body stabilization; and insufficient muscle strength for smooth body transfer.

Without significant hand gripping strength, exercise devices such as barbells, bench presses, spring resistant pulling devices and the like are not usable. Similarly rowing machines; arm rotation machines, which traditionally have the user sit upright on a bicycle seat; and most push/pull type devices and the like require the user to sit upright. This requires the use of stomach and back muscles which are often not available for the paraplegic or incomplete quadriplegic. Finally, any device which requires body transfer poses a hazard for the paraplegic or incomplete quadriplegic who, if capable, must use their arm strength to virtually throw their bodies from one place to another, thus subjecting themselves to trauma, falling etc. Such transfer is especially difficult, or impossible, where the transfer is being made to a small seat or bench.

The major advantages of the invention are set forth in part herein and in part will be obvious herefrom, or may be learned by practice with the invention, the same being realized and attained by means of the instrumentalities and combinations pointed out in the appended claims.

SUMMARY OF THE INVENTION

The present invention is an exercise cycle which is convertible between an arm exerciser and a leg exerciser. The new exercising machine has an upright frame mounted on a T-shaped base for stability. Two support rods, one at the front and the other at the rear, extend upwardly and angularly from the stem of the T-shaped base.

A flywheel assembly is rotatably journaled to a frame between the support rods. Tension on the flywheel is adjustable. Two L-shaped lever members are mounted on opposite sides of the frame and secured to each other by a transverse axel journaled to the frame for manually rotating the fly wheel, thus providing a means for exercising. When used as a leg exerciser, the machine is placed on the floor. To use the machine in this capacity, the user sits on a chair and places his or her feet on pedal attachments removably connected to the L-shaped lever members.

When used as an arm exerciser, the machine is mounted to a table top with a specialized clamping mechanism. A padded forehead rest, which is adjustable in position both horizontally and vertically, is provided, particularly for users such as paraplegics who need additional support while exercising. The user grasps hand grip attachments which have been secured to the L-shaped lever members and uses his or her arms to rotate the fly wheel. Three types of hand grips are available. The first is a rod shaped grip. The second, referred to as a limited grasp hand grip, has one rod shaped bar for grasping and two additional rods for supporting the back of the hand and fingers and for maintaining the hand in position on the grip. The latter grip is provided for those with limited gripping ability. The third grip, for users with virtually no gripping ability, has one rod shaped bar upon which the palm of the hand rests, and two moveable bars positioned to lock above and below the users wrist, securing the wrist therebetween.

As a further feature, the present invention includes grip securing means which allow the grip to be secured at various places along the vertical bars of the L-shaped lever members.

Still further, an electronic display unit mounted on the base of the machine displays the elapsed time from the start of cycling, the equivalent distance traveled, and the speed.

The accompanying drawings, referred to herein and constituting a part hereof, illustrate preferred embodiments of the invention, and together with the description, serve to explain the principles of the invention.

BRIEF DESCRIPTION OF THE DRAWINGS

Of the Drawings:

FIG. 2 is a perspective view of the basic hand grip;

FIG. 3 is an elevational view of a modified grip;

DETAILED DESCRIPTION OF THE DRAWINGS

Figure 1:
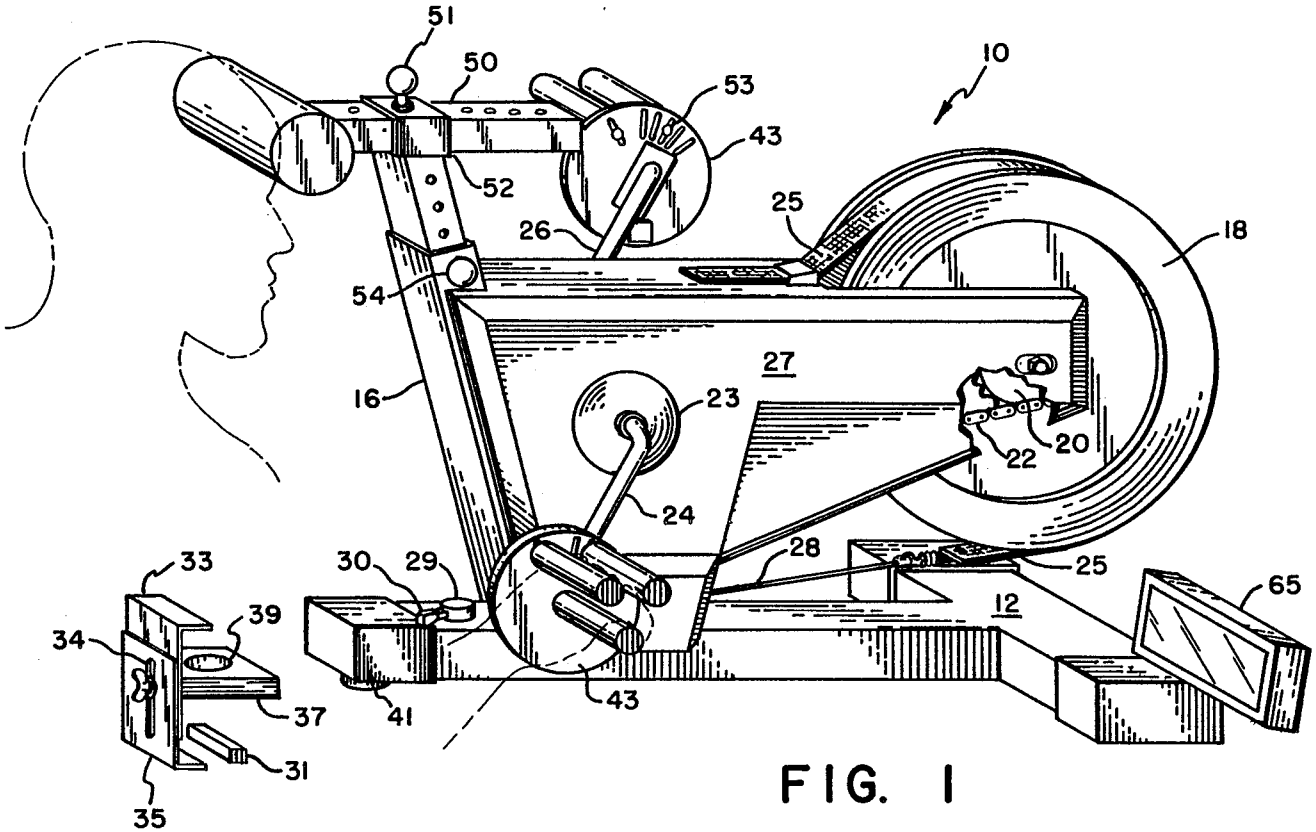
FIG. 1 is a perspective view of the exercise cycle constructed in accordance with the present invention.

With reference to FIG. 1, the exercise cycle constructed in accordance with the present invention is shown, generally designated by the numeral 10. FIG. 1 illustrates the convertible exercise cycle in use as an arm exerciser, however, it should be appreciated that the exerciser can easily be placed on the floor and used as a leg exerciser.

In the preferred embodiment of the present invention, the frame of the exercise cycle 10 comprises an T-shaped base 12 and two upwardly and angularly extending support rods 14 and 16, one toward the front and one toward the rear of the machine 10.

A flywheel assembly is supported by the frame 15 of the cycle 10. The flywheel 18 is mechanically interconnected to sprocket 20 rotationally interconnected by a roller chain 22 to rear sprocket 23, both the flywheel 18 and the sprocket 20 being journaled in the frame for rotation in a vertical plane as is well known in stationary bicycle art. L-shaped lever members 24 and 26 are mounted on opposite sides of the sprocket 23 to function as lever means for rotating the flywheel 18.

For additional support of the machine 10 and for user protection from movable mechanical parts, sides 27 of frame 15 function as chain guards for the cycle 10.

As in conventional exercise bicycles, a cable 28 is connected to a strap 25 which wraps partially around flywheel 18 and enables the user to adjust the resistance on the flywheel 18. To increase or to decrease the resistance, the user moves a knob 30 at the rear of the frame, thereby varying the pressure on one end of a lever 29 which is connected to the cable 28. This varies the tension on flywheel 18 to obtain the resistance level desired by the user.

To use the exercise cycle as an arm exerciser, the base 12 is attached to a tabletop with a unique three piece clamping system.

Two slideably engaged "L" shaped clamps, 33 and 35, have aligned slits 34 which enable them to move vertically with respect to each other when secured by a bolt and wing nut. A retention plate 37 is secured between the clamp extensions by said bolt and also moveable along slits 34. The retention plate has an opening 39 which is adapted to receive stud 41 which extends downwardly from the underside of the rearmost portion of base 12. In use, retention plate 37 is placed on a table and clamp 33 is raised sufficiently to receive the rearmost portion of base 12 so that stud 41 fits within opening 39. Clamp 33 is then moved downward on top of base 12 and clamp 35 is raised until the table is secured between clamp 35 and retention plate 37. If the table is too thin a wedge 31 may be secured between plate 37 and the table. The wing nut is then tightened, locking the parts in place.

For most people, a pedal or hand grip 38 as shown in FIG. 2 is sufficient. This grip comprises a circular protection plate member 43 with a single, padded cylinder secured for rotation to a race of ball bearings 45 and further secured to the horizontal bar of an L-shaped member, 24 or 26. However, for those persons who are unable to tightly grasp the above described hand grip, the limited grasp hand grip 40 shown in FIG. 1 may be used. To use the limited grasp hand grip 40, the users grasps the lower padded cylinder 42 to which the horizontal bar of the L shaped member has been secured. The upper padded cylinders 44 and 46 which are slideable adjustable through an array of slots 53 in protection plate member 43 engage the back of the hand and the fingers as the user grasps the lower cylinder 42, thus maintaining the user's hand in position on the grip 40.

FIG. 3 discloses a further alternate embodiment in the grip 40. In this embodiment, the hand grasps or lays on grip support 47 which is secured to an adjustment plate 49. Grip support 47 may be secured directly to plate 49, thereby maintaining its position relative to the support. Thus, there is no friction against the hand during use, and circular protection plate 43 is not necessary. The adjustment plate 49 has two parallel guide slots 55 which receive bolts 57 on wrist plate 59. A pair of openings 61 on wrist plate 59 allow for the moveable securing of padded wrist rods 63. The rods 63 are used to secure the users wrist while the hand rests on support 47 thereby allowing the user to use the exercise cycle even though the user does not have sufficient gripping power to hold the support 47.

A padded forehead rest 48 comprising a T-shaped member mounted on the rear support rod 16 of the cycle frame. The forehead rest 48 is particularly useful to support handicapped persons, such as paraplegics and incomplete paraplegics, who use the device 10 as an arm exerciser. The horizontal and vertical positions of the forehead rest 48 are adjustable. To adjust the horizontal position of the forehead rest 48, the bar 50 of the T-shaped forehead rest 48 is made to slide within a sleeve 52 to the desired position and is then secured by a nut 51. And, to adjust the vertical position of the forehead rest, the rear support rod 16 is telescopically adjustable by varying the length of the upper portion of the rod which is inserted into the lower portion of the rod. A pin 54 is inserted into coinciding holes in the upper and lower portions of the rod to secure them together. Preferably, the forehead rest 48 is padded for comfort.

Figure 4:
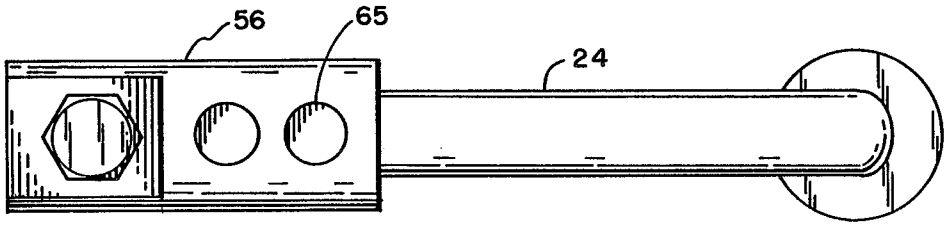
FIG. 4 is a front view of the lever extender used in the present invention.
Figure 5:
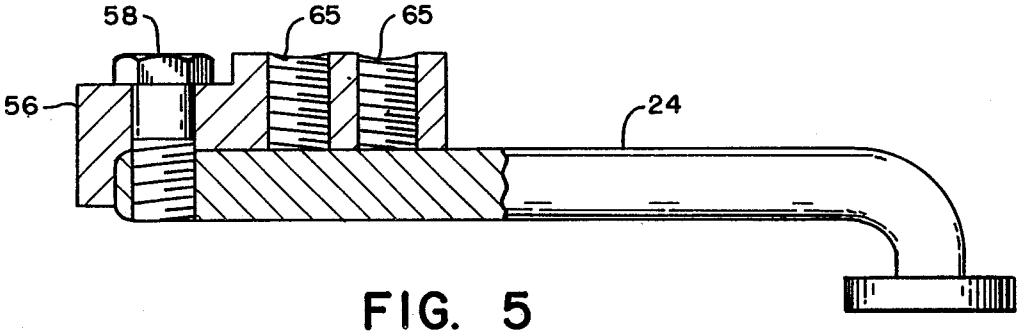
FIG. 5 is a side view in partial cross-section of the lever extender used in the present invention.

As a further adjustable feature of the exercise cycle 10, and as shown in FIGS. 4 and 5, a collar 56 may be secured by collar bolt 58 at the preferred location along the L-shaped lever members 24 and 26. For this purpose, a threaded receptacles 65 are used to secure the preferred grip in place.

Still further, a conventional electronic display unit 65 is mounted to the base 12. Preferably, the display indicates elapsed time from the start of cycling, the speed, and the equivalent distance traveled.

The invention in its broader aspects is not limited to the specific embodiments herein shown and described but departures may be made therefrom with the scope of the accompanying claims, without departing from the principles of the invention and without sacrificing its chief advantages.

What is claimed is:

1. A stationary seatless bicycle-like assembly having a base and a frame; rotation means including a transverse axle journaled in the frame and pedals rotatably mounted on each end of the axis, and means for varying the resistance of said rotational motion of the axle including a tension control wherein the improvement comprises:

a front support rod for supporting said rotation means and said pedals on said base and a vertically telescoping rear support rod extending upwardly from the base;

a bar slidably secured to the telescoping rear support rod for horizontal movement;

a forehead rest secured to the bar and extending outwardly therefrom, said rest being adjustable both horizontally and vertically by means of said vertically telescoping rear support rod and horizontally slidable bar; and a clamp mounted on the base for securing the base to a tabletop.

2. The invention of claim 1 further comprising:

a padded grip secured to and extending outwardly from the rotation means, said grip being independently rotatable; and a protection plate secured toward the end of the grip nearest the rotation means, said protection plate rotating with said grip, said protection plate being of sufficient size to block the hand from contacting the rotation means during operation.

3. The invention of claim 2 wherein said protection plate further comprises a plurality of openings; and cylinders secured within said openings, said cylinders aligned to secure the user's hand in relation to said grip.

4. A stationary bicycle-like assembly having a base and frame; rotation means including a transverse axle journaled in the frame and cranks rotatably mounted on each end of the axle, and means for varying the resistance of said rotational motion of the axle including a tension control wherein the improvement comprises:

padded gripping means secured to and extending outwardly from the rotation means, said gripping means being independently rotatable;

a protection plate secured toward the end of the gripping means nearest the rotation means, said protection plate rotating with said gripping means and thereby preventing contact between the user and the rotation means during operation, said protection plate having openings therein and cylinders secured within said openings and forming a substantially triangular shape with said gripping means, said cylinders being movable vertically toward and away from the gripping means in order to secure the user's hand against said gripping means.

5. A stationary bicycle-like assembly having a base and frame; rotation means including a transverse axle journaled in the frame and cranks rotatably mounted on each end of the axle, and means for varying the resistance of said rotational motion of the axle including a tension control wherein the improvement comprises:

padded gripping means secured to and extending outwardly from the rotation means, said gripping means being independently rotatable;

a protection plate secured toward the end of the gripping means nearest the rotation means, said protection plate rotating with said gripping means and thereby preventing contact between the user and the rotation means during operation, said protection plate having elongate openings therein;

a wrist plate adapted for movable securement within said elongate openings, said wrist plate having adjacent slots therein; and a pair of rods securable within said slots whereby the combined movement of the plate and the rods enables the user to secure the wrist between said rods while the hands rest on the gripping means.

* * * * *